United States Patent [19]

Takeda

[11] 4,184,874

[45] Jan. 22, 1980

[54] PHOTOSENSITIVE COMPOSITION CONTAINING CHELATE COMPOUND

[75] Inventor: Keiji Takeda, Asaka, Japan

[73] Assignee: Fuji Photo Film Co., Ltd., Minami-ashigara, Japan

[21] Appl. No.: 547,153

[22] Filed: Feb. 5, 1975

[30] Foreign Application Priority Data

Feb. 5, 1974 [JP] Japan ..... 49-14760

[51] Int. Cl.[2] ..... G03C 5/24; G03C 1/02; G03C 1/52

[52] U.S. Cl. ..... 430/336; 430/337; 430/341; 430/338

[58] Field of Search ..... 96/90 PC, 90 R, 48 HD, 96/92, 93, 94 R; 260/45.75 R

[56] References Cited

U.S. PATENT DOCUMENTS 3,561,969 2/1971 Burg ..... 96/90 R 3,582,327 6/1971 Boyd et al. ..... 96/28

3,887,808 6/1975 Houte et al. ..... 96/90 PC

OTHER PUBLICATIONS

J. T. Adams et al., J. Amer. Chem. Soc., vol. 66, pp. 1221–1222.

J. T. Adams et al., J. Amer. Chem. Soc., vol. 66, p. 1220, (1944).

*Primary Examiner*—Thomas J. Herbert, Jr.

*Attorney, Agent, or Firm*—Sughrue, Rothwell, Mion, Zinn and Macpeak

[57] ABSTRACT

A photosensitive composition containing a β-diketonato-metal chelate compound as an image-forming material with or without a sensitizer, and suitable for use as a direct print-out image recording material, a photochromic material, a heat-developable image recording material or a heat-developable and photo-fixable image recording material.

13 Claims, No Drawings

PHOTOSENSITIVE COMPOSITION CONTAINING CHELATE COMPOUND

BACKGROUND OF THE INVENTION

1. Field of the Invention

This invention relates to a photosensitive composition, and more specifically, to a photosensitive composition containing a β-diketonato-metal chelate compound as an image-forming material.

2. Description of the Prior Art

A number of photographic materials are presently known which provide stable images directly by exposure, or which form latent images by exposure and provide stable developed images by chemically or physically treating the latent images. Furthermore, many reversible photographic materials are known which provide images directly by exposure, but in which the images are erased upon standing at room temperature or heating and the images changed or new images formed by additional exposure (i.e., photochromic materials). The materials used as a photosensitive material or an image-forming material in these photographic materials include inorganic compounds, organic compounds and organic acid metal salts as well as elemento-organic compounds such as organo-metallic compounds.

Inorganic compounds include, for example, metal halides such as silver halides. Of these, non-silver salts are described in detail in J. Kosar, *Light-Sensitive Systems,* John Wiley & Sons, (1965). As organic compounds, diazo compounds, photopolymers and free radical generating photographic materials are known, the first two being described in detail in Kosar, supra. Photographs generated using free radicals are obtained by a photographic process which uses a polyhalogenated hydrocarbon capable of generating free radicals due to the action of light such as carbon tetrabromide and an amine such as diphenyl amine capable of forming a dye upon reaction with free radicals or a compound contributing to the formation of an image as a result of the simultaneous occurrence of a polymerization reaction and color formation, such as N-vinyl carbazole, for example, as described in detail in R. H. Sprague, *Phot. Sci. & Eng.,* Vol. 5, page 298, ibid., Vol. 8, pages 91 and 95 and ibid., Vol. 9, page 133, and U.S. Pat. Nos. 3,042,517 and 3,042,519. Metal salts of an organic acid include, for example, a dry silver material in which silver behenate is used as an image-forming substance and silver bromide is used as a photo-catalyst, for example, as described in detail in Japanese Patent Publication Nos. 2096/63, 4921/68 and 4924/68. Recently, a photographic material using an elemento-organic compound containing a chalcogen element (directly) bonded to an organic compound (for example, as disclosed in Japanese Laid-Open Patent Publication No. 29438/73) has been developed. Photochromic materials are described in detail in Kosar, supra.

These various photographic materials have their own advantages and disadvantages.

Silver halide photographic materials have found wide applications because of their high sensitivity, but have the disadvantage that they need complicated wet developing and fixing operations and the cost of production is high because silver is used. Diazo photographic materials, on the other hand, are less expensive, but generally require wet development using an alkali. Even in the case of dry heat-developable diazo photographic materials, the generation of an alkali is necessary. Vesicular photographic processes using diazo compounds are dry processes which do not require an alkali, but since there is no formation of color, such processes are used only for photographic materials for transparencies. Photopolymers require wet development, and since color formation does not occur, they are difficult to use for general photographic processes. Photographic materials in which free radical generating materials are used are generally of the dry type, but mostly have disadvantages with respect to their sublimability, toxicity and stability. Furthermore, the resulting images are generally unstable, and in many cases, difficult to fix.

Photographic processes using the above-described dry silver and elemento-organic compounds respectively are known as photographic processes in which development is performed in the dry state, for example, by heating, and in which the disadvantages of the radical photographic process have been eliminated to no small extent. The former has the advantage that development can be carried out in the dry state and fixation is not required, but on the other hand, suffers from the disadvantage that it is difficult to use for transparent images because expensive silver is used and the photographic material is a crystal dispersion system. The latter can be developed in the dry state, but fixation is difficult. In addition, the compound used for this photographic material is susceptible to hydrolysis, and the toxicity of some of the chalcogens also poses a problem.

SUMMARY OF THE INVENTION

A first object of this invention is to provide a novel non-silver salt photographic material in which latent images are formed on exposure and stable images can be obtained by development of the latent image in a dry state, thus requiring no fixation.

A second object of this invention is to provide a novel photographic material which provides stable print-out images immediately on exposure.

A third object of this invention is to provide a novel photographic material in which images are formed directly by exposure but can be erased on standing at room temperature (e.g., about 20°~30° C.), and by re-exposure, images are again formed by a second image-wise exposure, thus permitting repeated use (i.e., a novel photochromic material).

A fourth object of this invention is to provide a photographic material having improved stability to moisture, oxygen and heat in comparison with conventional photographic materials.

A fifth object of this invention is to provide an inexpensive photographic material by an appropriate selection of a metal element.

A sixth object of this invention is to provide a photographic material using a material having little or no toxicity by selecting an appropriate metal element.

It has now been found that by exposing a photosensitive composition containing a chelate compound formed by reacting a β-diketone compound with a metal, i.e., a β-diketonato-metal chelate compound, (preferably additionally containing a suitable sensitizer), (1) an image is directly obtained, or (2) a latent image is formed in the layer on exposure and by subsequent heating, the latent image is developed to form a stable image.

Accordingly this invention provides a photosensitive composition containing a β-diketonato-metal chelate compound and a photosensitive material comprising a support having thereon a layer of a photosensitive composition containing a β-diketonato-metal chelate compound.

DETAILED DESCRIPTION OF THE INVENTION

Preferably, the β-diketone compound used in this invention is one represented by the following general formula (I)

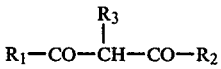

(I)

In the above formula (I), $R_1$, $R_2$ and $R_3$ each represents an aliphatic group (e.g., having 1 to 10 carbon atoms, for example, an alkyl group, preferably those alkyl groups having 1 to 10 carbon atoms, such as a methyl, ethyl, propyl or butyl group (including the isomers of these groups); a haloalkyl group such as a trifluoromethyl, tribromomethyl or trichloromethyl group; ethylenically or acetylenically unsaturated groups which may be unsubstituted or substituted with a halogen atom, etc., in which at least one methylene group is directly bonded to the CO group such as an allyl group, a 4-butenyl group, a 3-pentenyl group; an alkyl group containing —O—, —S—, —CO—, —CS—, —NH— bonding in the alkyl chain in which at least one methylene group is directly bonded to the CO group such as $—CH_2OH$, $—CH_2OCH_3$, $—CH_2CH_2SCH_3$,

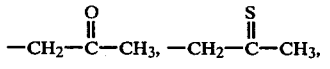

$—CH_2CH_2—OH$, $—CH_2CH_2OCH_3$, $—CH_2CH_2OCH_2CH_3$, $—CH_2—NH—CH_3$, $—CH_2CH_2NHCH_2CH_3$, etc.); an aryl group (such as a phenyl group or a substituted phenyl group having a substituent selected from alkyl groups, preferably those alkyl groups containing 1 to 5 carbon atoms, such as a methyl or ethyl group, halogen atoms such as an iodine, bromine, chlorine or fluorine atom, haloalkyl groups having 1 to 5 carbon atoms in the alkyl moiety, a hydroxyl group, hydroxyalkyl groups having 1 to 5 carbon atoms in the alkyl moiety, alkoxy groups having 1 to 5 carbon atoms in the alkoxy moiety such as a methoxy or ethoxy group, alkoxyalkyl groups having 1 to 5 carbon atoms in the alkyl moiety and in the alkoxy moiety, a cyano group, an acetyl group, aralkyl groups having 1 to 5 carbon atoms in the alkyl moiety such as a benzyl or phenethyl group, aryloxy groups, amino groups, alkylamino groups having 1 to 5 carbon atoms in the alkyl moiety or moieties, and a nitro group; naphthyl; anthryl; and the like;) or a heterocyclic residue (such as a furan or thiophene group which may optionally be substituted, e.g., with an alkyl group having 1 to 5 carbon atoms such as a methyl, ethyl, or propyl group, a halogen atom such as a fluorine, chlorine, bromine or iodine atom, an alkoxy group having 1 to 5 carbon atoms in the alkoxy moiety, etc.). $R_3$ can also be a hydrogen atom.

Chelate compounds formed from these β-diketone compounds and metal ions ($M^{n\oplus}$) are expressed by the following general formula (II)

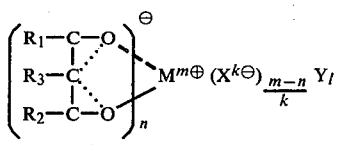

(II)

wherein $M^{n\oplus}$ is a metal ion or a complex metal ion capable of forming a chelate compound with a β-diketone and m is an integer corresponding to the positive charge of the metal ion or the complex metal ion, $X^{k-}$ is an anion, Y is a neutral ligand, k is an integer of 1 (one) to (m−n), n is an integer of 1 (one) to m, and l is an integer of 0 to 3.

The method for preparing these chelates is described in detail, for example, in J. T. Adams and C. R. Hauser, *J. Am. Chem. Soc.*, Vol. 66, page 1220, (1944). The chelate compounds used in this invention can be prepared substantially in accordance with this method.

Of the above β-diketonato chelate compounds of the general formula (II), acetylacetonates (i.e., in which $R_1$ and $R_2$ are methyl groups and $R_3$ is a hydrogen atom) are compounds which are especially preferably used in the present invention. Acetylacetone (to be abbreviated "acac" hereinafter) is known to form a stable or comparatively stable chelate with almost all metals. Some of these metal chelate compounds (in the photosensitive layer) provide images on exposure. Alternatively, by using the metal chelate compound conjointly with a suitable sensitizer, the acetylacetonato-metal chelate compound (in the layer) can directly provide images by exposure, or by heat-development. Metals which can be used in the β-diketonato-metal chelate include Be, Mg, Al, Si, Ca, Sc, Ti, V, Cr, Mn, Fe, Co, Ni, Cu, Zn, Ga, Ge, Rb, Sr, Y, Zr, Nb, Mo, Tc, Ru, Rh, Pd, Ag, Cd, In, Sn, Cs, Ba, Ce, Sm, Nd, La, Hf, Ta, W, Re, Os, Ir, Pt, Au, Hg, Te, Pb, Th, or U. Specific examples of acetylacetonato-metal chelate compounds include bis-compounds such as $Co(acac)_2$, $Zn(acac)_2$, $U(IV)O_2(acac)_2$, $Cd(acac)_2$, $Ca(II)(acac)_2(OH_2)_2$, $Sr(acac)_2$, $Ba(II)(acac)_2(OH_2)_2$, $Co(II)(acac)_2(NH_3)_2$, $Fe(acac)_2$, $Hg(acac)_2$, $Cu(acac)_2$, $Ni(acac)_2$, $Pt(acac)_2$, $Pd(acac)_2$, $Be(acac)_2$, $B(III)(acac)_2X$, $Mg(acac)_2$, $Mn(acac)_2$, $Mo(acac)_2$, $SnCl_2(acac)_2$, $VO(acac)_2$, $Mo(IV)O_2(acac)_2$, $TiO(acac)_2$ and $Pb(acac)_2$; tris-compounds such as $Al(acac)_3$, $In(acac)_3$, $Ga(acac)_3$, $Cr(acac)_3$, $[Si(acac)_3]X$, $[Ge(acac)_3]X$, $Co(acac)_3$, $Na[Co(II)(acac)_3]$, $Sm(acac)_3$, $Sc(acac)_3$, $Ce(acac)_3$, $[Ti(acac)_3]_2$, $[Ti(acac)_3][FeCl_4]$, $[Ti(acac)_3]_2[PtCl_6]$, $Fe(acac)_3$, $Nd(acac)_3$, $V(acac)_3$, $Mn(acac)_3$, $La(acac)_3$, $Ru(acac)_3$ and $Rh(acac)_3$; and tetrakis-compounds such as $U(acac)_4$, $Zr(acac)_4$, $Ce(acac)_4$, $Th(acac)_4$, and $Hf(acac)_4$. In the above example, X represents $Cl^-$, $I^-$, $I_3^-$, $ZnCl_3^-$, $SnCl_6^{--}$, $SnCl_5^-$, $FeCl_4^-$, $AuCl_4^-$, $CuCl_2^-$, $CuBr_2^-$, $Cu_2Br_3^-$, or $CuBr_3^-$, etc.

Chelate compounds formed from β-diketones such as

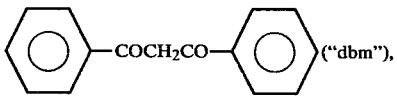

("dbm"),

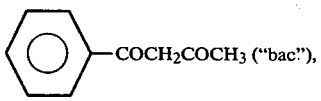

("bac"), $CF_3COCH_2COCH_3$,

-continued $CF_3COCH_2COCF_3$ ("hfacac"), $CH_3COCH_2CO—C(CH_3)_3$,

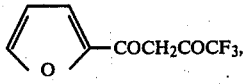

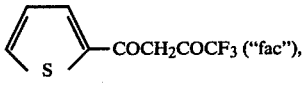

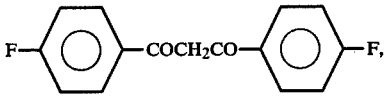

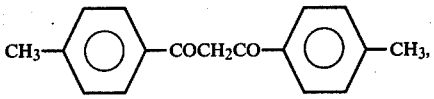

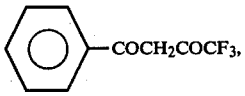

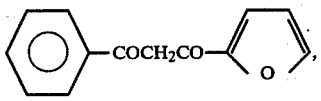

$CF_3COCH_2CO—C_5H_{11}$,

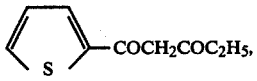

$CH_3COCH_2COCH_2CH=CH_2$, $CF_3COCH_2COCH_2CH_2OCH_3$, etc., and various metal atoms can also be used conveniently in the present invention, e.g., where "acac" in the above-described specific examples is replaced by "dbm," "bac," "hfacac," "fac," etc., and more preferably chelates of Co(II), Cd, Fe(II), Ni, Pd, In and Ce with "dbm," chelates of Zn, Ba, Hg, Pt, Mo(II), Ga and Si with "bac," chelates of $U(IV)O_2$, Cu(II), Mg, $Sn(II)Cl_2$, Ti(II)O, Co(III) with "hfacac" and chelates of Mn(II), VO(II), V(III), Rh(III), Ce(IV), Zr(IV) with "fac". The abbreviation "fac" is to be used in this context only in the present specification.

Many of these $\beta$-diketonato-metal chelate compounds form visible images in a suitable binder layer directly by exposure or through heat-development. However, by using a suitable sensitizer, the chelate compound becomes photosensitive, or possesses a markedly increased sensitivity as compared with the case where a sensitizer is not employed.

Various organic dyes are effective as sensitizers, but organic carbonyl compounds are especially suitable for use in the present invention. Examples of these compounds are quinones of the following general formulae (IIIa) to (IIIf).

(IIIa)

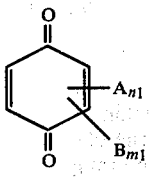

-continued (IIIb)

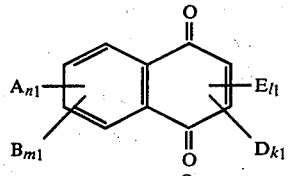

(IIIc)

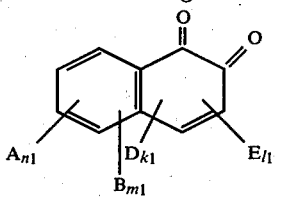

(IIId)

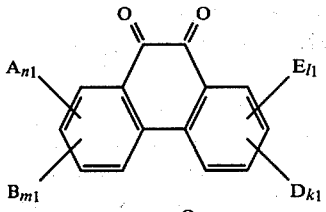

(IIIe)

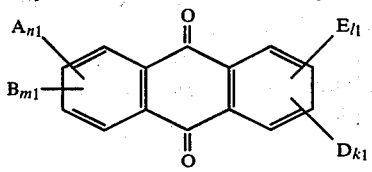

(IIIf)

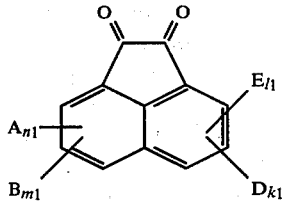

In these formulae, $n_1$, $m_1$, $l_1$ and $k_1$ are positive integers with the proviso that $n_1+m_1 \leqq 4$, and $l_1+k_1 \leqq 4$; and A, B, D and E each represents a hydrogen atom, an aliphatic group (e.g., having 1 to 10 carbon atoms, for example, an alkyl group, preferably an alkyl group having 1 to 10 carbon atoms such as a methyl, ethyl, propyl (n- or iso-) or butyl (n-, iso- or sec-) group, or a substituted alkyl group having 1 to 10 carbon atoms in the alkyl moiety and in which the substituent is, for example, a hydroxyl group, a halogen atom such as a fluorine, chlorine, bromine or iodine atom, an alkoxy group such as a methoxy or ethoxy group, or an aryl group such as a phenyl or substituted phenyl group); an aryl group (for example, a phenyl group, a biphenyl group or a substituted phenyl or biphenyl group in which the substituent is, for example, an alkyl group, preferably an alkyl group containing 1 to 5 carbon atoms such as a methyl or ethyl group, a substituted alkyl group having 1 to 5 carbon atoms in the alkyl moiety such as a haloaryl group in which the halogen atom is a chlorine, bromine, fluorine or iodine atom, a hydroxyalkyl group, an alkoxyalkyl group such as a methoxyalkyl group or an ethoxyalkyl group, etc., a halogen atom such an iodine, bromine, chlorine or fluorine atom, a hydroxyl group, an alkoxy group having 1 to 5 carbon atoms in the alkoxy moiety such as a methoxy or ethoxy group, a cyano group, an acetyl group, a nitro group, a phenyl group, a biphenyl group, a vinyl group, an allyl group, an amino group, or an alkylamino group having 1 to 2 carbon atoms in the alkyl moiety or moieties); a halogen atom such as a chlorine, bromine or iodine atom; an —$OR_4$ group; a cyano group; a nitro group; an —$NR_4R_5$ group; an —$SO_3R_4$ group; a —$COOR_4$ group; an acyl group having 1 to 5 carbon atoms such as an acetyl group; a vinyl group, a styryl group, an allyl group or an —$NHCOR_4$ group; in which $R_4$ and $R_5$ each represents a hydrogen atom or an aliphatic group, e.g., as exemplified above for A, B, D and E. These compounds of the general formulae (IIIa) to (IIIf) are described in detail in U.S. Pat. Nos. 2,610,120, 2,670,285, 2,670,287, 2,690,966, 2,732,301, 2,835,656, 2,956,878, 3,023,100, 3,066,117, 3,173,787, 3,357,831, 3,409,593, 3,418,295, 3,453,110, 3,475,617, 3,561,969, 3,575,929, 3,582,327, 3,647,470, 3,721,566, and 3,737,319.

Specific examples of these quinones are benzoquinone, p-toluquinone, duroquinone, trimethylbenzoquinone, p-xyloquinone, 2-phenylbenzoquinone, chloro-p-benzoquinone, bromo-p-benzoquinone, chloranil, bromanil, iodanil, hydroxy-p-benzoquinone, 2,3-dicyano-p-benzoquinone, acetyl-p-benzoquinone, p-benzoquinonesulfonic acid, α-naphthoquinone, β-naphthoquinone, 3-methyl-1,2-naphthoquinone, 3,6-dimethyl-1,2-naphthoquinone, 2,5-dimethyl-1,4-naphthoquinone, 2,6-di-tert-butyl-1,4-naphthoquinone, 4-benzyl-1,2-naphthoquinone, 3-chloro-1,2-naphthoquinone, 2-chloro-1,4-naphthoquinone, 3-nitro-1,2-naphthoquinone, 5-acetamino-1,2-naphthoquinone, 3-acetyl-1,2-naphthoquinone, 9,10-anthraquinone, 2-bromoanthraquinone, 1-nitroanthraquinone, 1,5-dihydroxyanthraquinone, 1-chloro-2-aminoanthraquinone, 2-tert-butyl anthraquinone, 1,4-dimethoxyanthraquinone, 1,4-diaminoanthraquinone, 1-acetylaminoanthraquinone, anthraquinone-α-carboxylic acid, phenanthrenequinone, and acenaphthenequinone.

Aryl ketones of the following formulae (IVa) to (IVe) can also be used.

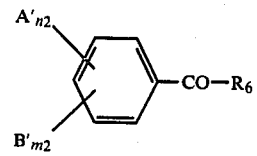

(IVa)

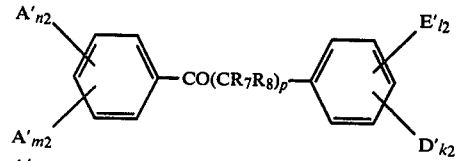

(IVb)

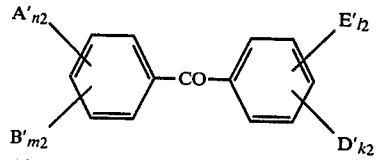

(IVc)

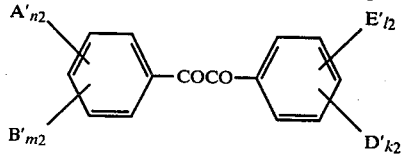

(IVd)

-continued

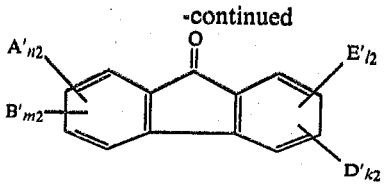

(IVe)

In the above formulae, $n_2$, $m_2$, $l_2$ and $k_2$ are positive integers with the proviso that $n_2+m_2 \leqq 5$, and $l_2+k_2 \leqq 5$; p is a positive integer, preferably not more than 10; $R_6$ represents an aliphatic group as described with respect to general formulae (IIIa) to (IIIf), an acetylmethyl group, a benzoylmethyl group, substituted groups of the above groups (for example, those groups having a substituent as described with respect to the aryl group in general formulae (IIIa) to (IIIf), or an alkenyl group having 2 to 10 carbon atoms, preferably 2 to 4 carbon atoms, (e.g., unsubstituted or substituted alkenyl groups such as vinyl, allyl, 1-propenyl, 2-butenyl, iso-propenyl, 1-hexenyl, 7-octenyl, etc. with suitable substituents being a halogen atom, a haloalkyl group or a cyano group); $R_7$ and $R_8$ each represents an alkyl group having 1 to 10 carbon atoms such as a methyl or ethyl group, or a halogen atom such as fluorine, chlorine, bromine or iodine atom; and A', B', D' and E' are the same as A, B, D and E in general formulae (IIIa) to (IIIf). These compounds of the general formula (IVa) to (IVe) are described in detail in U.S. Pat. Nos. 2,610,120, 2,670,285, 2,670,287, 2,690,966, 2,732,301, 2,835,656, 2,956,878, 3,023,100, 3,066,117, 3,173,787, 3,357,831, 3,409,593, 3,418,295, 3,453,110, 3,475,617, 3,561,969, 3,575,929, 3,582,327, 3,647,470, 3,721,566, and 3,737,319.

Specific examples of the aryl ketones include acetophenone, 2,4,5-trimethylacetophenone, 2-ethylacetophenone, p-bromoacetophenone, ω-tribromoacetophenone, dibenzoylmethane, benzoylacetone, 2,4-dihydroxyacetophenone, acetophenone-4-sulfonic acid, acetophenone-4-carboxylic acid, diacetylbenzene, ω-phenylacetophenone, benzophenone, Michler's ketone, 3-nitrobenzophenone, 3-cyanobenzophenone, benzil(dibenzoyl), 9-fluorenone, and 2,4,7-trinitrofluorenone.

The photosensitive layer used in this invention is prepared by dissolving or dispersing the above chelate compound and if desired, a sensitizer and a binder in a common solvent for these compounds, coating the resulting solution or dispersion on a support using a coating rod, a roller coater or a curtain coater, etc., and then drying the coated layer. A suitable dry thickness of the photosensitive layer is about 0.5 to about 500 microns, preferably 1 to 50 microns. Desirably, the concentration of the binder in the coating solution, the type of the coating rod at the time of coating, or the coating pressure are adjusted so as to provide a photosensitive layer of such a thickness. It is desirable to perform the drying of the layer generally at a temperature of not more than about 100° C., e.g., at about 30° C. to about 100° C., preferably 50° C. to 80° C.

The amounts of the chelate compound and the sensitizer can be varied over a wide range, but in order to provide a stable layer free from cracking or loss of transparency, the amount of each of the chelate compound and the sensitizer, if present, preferably does not exceed about 60% by weight based on the weight of the binder and preferably is at least about 1%. The concenration of the binder in the solution varies depending on the viscosity of the binder solution, but is preferably about 1 to 50% by weight of the solvent. The weight ratio of the amount of the chelate compound to the amount of the sensitizer can be varied as desired, and can be selected depending on the photosensitivity desired and the image density desired. Where a sensitizer is used, the sensitizer is preferably employed in an amount of about 1 to 300 parts by weight per 100 parts by weight of the chelate compound.

A wide range of synthetic or natural polymers can be used as the binder, but those binders which are capable of being stored for prolonged periods of time, are readily soluble in solvents, and have film-forming properties are preferred. Accordingly, binders having a molecular weight of about 1,000 to 500,000 are generally preferred. Examples of suitable binders are polymers such as synthetic polymers, for example, vinyl polymers such as polyvinyl chloride, polyvinylidene chloride, a copolymer of vinylidene chloride and acrylonitrile (with the proportion of acrylonitrile being about 50 mol% or less) polyvinyl acetate, polyvinyl formal, polyvinyl butyral, polystyrene, polymethyl methacrylate, polyvinyl alcohol or polyvinyl pyrrolidone, nylons and polyesters as condensation polymers; semi-synthetic polymers such as acetyl cellulose, carboxymethyl cellulose, ethyl cellulose, (meth)acrylated gelatin, phthalated gelatin, etc.; and natural polymers such as gelatin, natural rubber, albumin, casein, etc.

High polar solvents are preferred since it is generally necessary to dissolve the $\beta$-diketonato-metal chelate compound (the image-forming material). Furthermore, in order to maintain the rate of drying at a suitable rate, the use of solvents having extremely low or high boiling points are not preferred. Suitable solvents for use in this invention have a boiling point of about 40° to about 200° C. Examples of such solvents are N,N-dimethylformamide; dimethyl sulfoxide; aliphatic ketones such as acetone or methyl ethyl ketone; lower monohydric alcohols (e.g., with 1 to 7 carbon atoms) such as methanol, ethanol or isopropanol; lower dihydric alcohols (e.g., 1 to 5 carbon atoms) such as ethylene glycol or propylene glycol; cyclic ethers such as tetrahydrofuran or dioxane; esters and ethers such as ethyl acetate or ethylene glycol monomethyl ether; halogenated hydrocarbons such as chloroform, carbon tetrachloride, methylene chloride or trichloroethylene; aromatic hydrocarbons such as benzene, toluene or xylene and their substituted derivatives, for example, the halogen substituted derivatives.

Any material which can support a thin photosensitive layer and has good adhesion to the binder of the layer can be used as the support of the photographic material of this invention. Preferably, glass sheets, aluminum plates, synthetic resin sheets, paper, and paper laminates using synthetic resins are used. The support can either be transparent or opaque, or lustrous or non-lustrous. Examples of suitable materials for the support are transparent synthetic or semi-synthetic polymers such as polyesters, polyimides or triacetyl cellulose; opaque polymers such as cellulose fibers, paper, wooden plates or paper-like sheets; and inorganic materials such as metal plates or glass sheets. In order to produce a photographic material in the form of a roll, the use of a thin film-like support is preferred. Desirably, the thickness of the support is generally about 10 microns to 1 mm although the thickness of the support can vary depending on purpose of using the photographic material. The photographic material, in some cases, need not contain a support. In such a case, a photosensitive layer is coated on a glass sheet or metal plate, etc., and dried, and then the coated layer is removed from the support with the photosensitive layer itself acting concurrently as a support.

Images can be produced by any of the following methods (A) and (B).

METHOD (A)

The photosensitive layer is exposed imagewise to form a latent image which is then developed by heating. A suitable exposure time is, for example, when a mercury lamp or a xenon lamp of about 1 kw is used with the exposure being at a distance of about 50 cm, about 0.01 to 300 seconds, preferably 0.1 to 60 seconds. Thus, a negative-type image to the original can be obtained. When the coloration by the sensitizer is relatively dense, the color of the exposed area is bleached by photolysis of the sensitizer to sometimes form a positive-type light-colored image. However, a negative image is formed in the bleached portion by heat-development. By exposing the entire surface of the photosensitive layer subsequently, the coloration of the remaining sensitizer can be removed by bleaching. A suitable exposure time is, for example, when a tungsten lamp, a mercury lamp, a xenon lamp or a carbon arc of about 1 kw is used with the exposure being at a distance of 50 cm, about 1 to 300 seconds, preferably 10 to 60 seconds. In other words, light fixation is possible. When there is reduced coloration by the sensitizer, an image is formed in the exposed area, and no positive image occurs due to a bleach out of the sensitizer. Accordingly, the image is stable, and fixation is not required unless heating is done.

Generally, images formed by development are negative to the original and mostly black, brown, green, blue, red or orange in color. The color differs mainly according to the type of the chelate compound or the type of the sensitizer employed. Development by heating can be effected by intimately contacting the exposed photographic material with a hot plate heated to a uniform temperature, by heating the photographic material using thermal radiation, e.g., using an infrared lamp, or by immersing the exposed photographic material into a pre-heated fluid which is inert to the photographic material. The heating temperature varies according to the type of the chelate compound or a combination of the chelate compound with sensitizer, but generally is about 50° to 200° C., especially preferably 80° to 150° C. The heating time is generally about 3 seconds to 3 minutes, preferably 10 seconds to 1 minute.

METHOD (B)

When the photosensitive layer is imagewise exposed, a negative image to the original can be obtained. A suitable exposure time is, for example, when a mercury lamp or a xenon lamp of about 1 kw is used with the exposure being at a distance of about 50 cm, about 0.01 to 300 seconds, preferably 0.1 to 60 seconds. The color of the image differs depending mainly on the type of chelate compound or the type of sensitizer employed, but is mostly black, brown, green, blue, red or orange. The resulting direct print-out image is generally unstable, and disappears upon standing for 1 to 10 days at room temperature (20° to 30° C). If the material is again exposed imagewise, a second image corresponding to the second image-wise exposure is formed. In other words, the above photosensitive layer is photochromic.

Which of the two processes (A) or (B) is chosen is determined mainly by the β-diketonato-metal chelate compound used in the photosensitive layer, and also by the type of sensitizer. If the sensitizers used are different, the photosensitive layer sometimes exhibits both of the properties described in Methods (A) and (B) even when the same chelate compounds are used. The properties of the photosensitive layer can also be just intermediate between those described in Methods (A) and (B). Specifically, a light-colored negative image to the original is formed, and on further heating, the image becomes denser, in other words, the image is developed. In any of the methods (A) and (B), exposure can be performed using visible light or ultraviolet light from a xenon lamp, a mercury lamp, a tungsten lamp, a carbon arc, etc. Electromagnetic waves of shorter wavelengths, such as X-rays and γ-rays, are also suitable for exposure and are included within the definition of "light" used to form images in the present invention. A suitable wavelength of light to form images is determined by the spectral sensitivity characteristics of the photographic material. This depends mainly upon the spectral characteristics of the sensitizer, that is, the absorption wavelength region and the nature of the electronic transition, but is also affected to a certain extent by the combination of the sensitizer and the chelate compound.

Some of the advantages achieved with the present invention are set forth below.

Firstly, by using the β-diketonato-metal compound as an image-forming substance or a photosensitive substance, a latent image is formed by exposure, and development of the latent image by heating provides a stable image. Therefore, fixation is not required, or light fixation can be performed by bleaching out the coloration of the sensitizer by light.

Secondly, by the selection of the chelate compound or the combined use of the chelate compound with a sensitizer, an image can be obtained directly by exposure. Generally, photographic materials having such a characteristic are useful as photochromic materials.

Thirdly, the β-diketonato-metal chelate compounds are generally simple to synthesize in high yields, and therefore, photographic materials can be provided at low cost.

Fourthly, because β-diketones form chelates with almost all metals, the desired compound can be selected from a wide range of compounds depending on the purpose of using the resulting photographic material. Furthermore, photographic materials having little or no toxicity or containing inexpensive metals can be produced.

Lastly, because β-diketonato-metal chelate compounds, especially those of difficultly ionizable metals, are generally very stable to moisture, oxygen and heat, photographic materials having good storage stability can be provided.

The following Examples are given to illustrate the present invention in greater detail. Unless otherwise indicated, all parts, percents, ratios and the like are by weight.

EXAMPLE 1

50 mg of $MoO_2(acac)_2$, 20 mg of 9,10-phenanthrenequinone and 250 mg of polyvinyl formal were dissolved in 2.5 ml of N,N-dimethylformamide. The resulting solution was coated on a 100 μ-thick polyester film using a coating rod, and dried at 60° C. for 2 hours to form a transparent photosensitive layer having a thickness of 10μ on the polyester film support. The resulting photosensitive layer was exposed for 1 minute using a 500 w xenon lamp as a light source located 10 cm away from the layer by bringing a wedge made of a silver halide photographic material into intimate contact with the photosensitive layer. A negative-type continuous black image with respect to the wedge image was obtained. This shows that the above photosensitive layer has the characteristics of a direct print-out image recording material.

EXAMPLE 2

70 mg of $[Ti(acac)_3]_2 \cdot TiCl_6$, 10 mg of 9,10-phenanthrenequinone, and 250 mg of polyvinyl butyral were dissolved in 2.5 ml of N,N-dimethylformamide. The resulting solution was coated on a baryta paper support using a coating rod, and dried at 60° C. for 2 hours to form a 10 μ-thick photosensitive layer on the support. This layer was exposed for 1 minute in the same way as in Example 1. A negative-type continuous brown image with respect to the wedge image was obtained. This image for the most part disappeared on standing for 3 days at 25° C., but by again exposing the material for 1 minute in the same manner as in Example 1, a continuous brown image having almost the same density as the original image was obtained. This shows that the above photosensitive layer has the characteristics of a photochromic material.

EXAMPLE 3

50 mg of $Mg(acac)_2$, 40 mg of benzil and 250 mg of polyvinyl formal were dissolved in 2.5 ml of N,N-dimethylformamide. The resulting solution was coated on a polyester support and dried in the same way as in Example 1 to form a 10μ-thick transparent photosensitive layer. When this layer was exposed for 1 minute in the same manner as in Example 1, no appreciable visual change was observed. When this exposed layer was heated for 10 seconds in intimate contact with a hot plate heated to 150° C., a negative-type continuous bluish green image was obtained with respect to the wedge image. This image was stable for prolonged periods of time, that is, at least one month. Since exposure alone did not cause an image, no fixing operation was required. This shows that the above photosensitive layer has the characteristics of a heat-developable image recording material which provides only a latent image on exposure.

EXAMPLE 4

50 mg of $Cu(acac)_2$, 10 mg of 9,10-phenanthrenequinone, and 250 mg of polyvinyl formal were dissolved in 3 ml of chloroform. The resulting solution was coated on a polyester film support and dried in the same way as in Example 1 to form a 10μ-thick photosensitive layer. When this layer was exposed in the same manner as in Example 1, an image was scarcely observed. Subsequent heating of this layer in the same manner as in Example 3 at 100° C. for 30 seconds provided a negative-type continuous brown image with respect to the wedge image.

EXAMPLE 5

40 mg of $Zr(acac)_4$, 30 mg of 9,10-phenanthrenequinone and 250 mg of polyvinyl formal were dissolved in N,N-dimethylformamide. The resulting solution was coated on a polyester film support and dried in the same manner as in Example 1 to form a 10μ-thick photosensitive layer. When this layer was exposed for 1 minute in the same manner as in Example 1, the yellow color of the phenanthrenequinone faded in the photosensitive layer, and a light-colored positive-type image with respect to the wedge image was observed. However, no fresh negative image was seen to be formed in the exposed area. The resulting layer was heated at 150° C. for 20 seconds by the same method as in Example 3 to form a negative-type continuous green image with respect to the wedge image. A yellow color ascribable to the remaining phenanthrenequinone was present in the unexposed area, but was for the most part bleached by exposing the entire surface of the developed photosensitive layer for 30 seconds using the same xenon lamp located at a distance of 30 cm away from the layer. In this case, no fresh image was formed by the exposure, and the image remained unchanged as long as this layer was stored at a temperature of below 100° C. This shows that the above photosensitive layer has the characteristics of an image recording material which is heat-developable and can be fixed by light.

EXAMPLE 6

50 mg of $MoO_2(acac)_2$, 50 mg of α-naphthoquinone and 250 mg of polyvinyl formal were dissolved in 2.5 ml of N,N-dimethylformamide. The resulting solution was coated on a polyester film support and dried in the same manner as in Example 1 to form a 10μ-thick photosensitive layer. When this layer was exposed for 1 minute in the same manner as in Example 1, no image was seen to be formed. When this layer was heated at 150° C. for 30 seconds by the same method as in Example 3, a negative-type continuous bluish image was obtained with respect to the wedge image.

A comparison of the results with those obtained in Example 1 shows that a direct print-out image was obtained when the sensitizer was 9,10-phenanthrenequinone, but when the sensitizer was changed to α-naphthoquinone, exposure only resulted in a latent image which could be developed by heat. It can therefore be seen that by a mere choice of the sensitizer, the image-forming characteristics of a photographic material containing the β-diketonato-metal compound can be greatly changed.

EXAMPLE 7

100 mg of $MoO_2(acac)_2$ and 250 mg of polyvinyl butyral were dissolved in 2.5 ml of tetrahydrofuran. The resulting solution was coated on a polyester film support and dried in the same manner as in Example 1 to form a 10μ-thick photosensitive layer. When this layer was exposed for 1 minute in the same manner as in Example 1, a negative-type continuous brown image was obtained with respect to the wedge image. This shows that without the combined use of a sensitizer, the β-diketonato-metal chelate compound is photosensitive and can form an image on exposure.

Preferably, the use of chelates of metals having an extremely high susceptibility to oxidation, that is, having a high ionizing tendency, should be avoided from the standpoint of stability to moisture and oxygen. Accordingly, the use of chelates of Li, Na and K of the metals of Group IA of the periodic table preferably is avoided. Although Be, Mg and Ca in Group IIA are unstable, chelates of these metals can be used as image-forming substances, as shown, for instance, in Example 3 above.

Thus, especially preferred metal elements for use in preparing the chelate compounds in accordance with this invention are metal elements other than Li, Na, K, Be, B, C, N, O, P, S, halogen atoms, rare gases, and radioactive elements.

On the other hand, acetylacetone is especially preferred as the β-diketone to form a chelate compound with the above metals because acetylacetone is simple to synthesize and is relatively inexpensive.

While the invention has been described in detail and with reference to specific embodiments thereof, it will be apparent to one skilled in the art that various changes and modifications can be made therein without departing from the spirit and scope thereof.

What is claimed is:

1. A method of forming a stable image comprising image-wise exposing to active light a photosensitive recording material which comprises a support having thereon a layer of photosensitive composition containing:

(a) at least one β-diketonato-metal chelate compound represented by the following general formula (II)

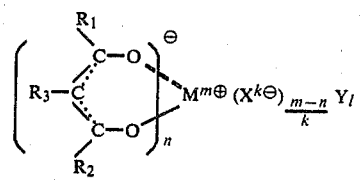

(II)

wherein $R_1$ and $R_2$ and $R_3$ represent an aliphatic group, an aryl group, or a hetercyclic group; $M^{m\oplus}$ is a metal ion or a complex metal ion capable of forming a chelate compound with a β-diketone and m is an integer corresponding to the positive charge of the metal ion or the complex metal ion; $X^{k\ominus}$ is an anion; Y is a neutral ligand; k is an integer of 1 (one) to (m-n); n is an integer of 1 (one) to m; l is an integer of 0 to 3; and $R_3$ can be a hydrogen atom;

(b) at least one optical sensitizer; and (c) a binder of synthetic or natural polymer, and heating said exposed material in order to either develop the latent image produced by said exposure or to intensify the visible image produced directly by said exposure.

2. The method of claim 1, wherein said binder polymer has a molecular weight of about 1,000 to about 500,000.

3. The method of claim 1, wherein the amount of said chelate compound is about 60% to about 1% by weight based on the binder.

4. The method of claim 1, wherein the amount of said optical sensitizer is about 60% to about 1% by weight based on the binder.

5. The method of claim 1, wherein the thickness of said photosensitive layer is about 0.5 μm to about 500 μm.

6. The method of claim 1, wherein heating of said exposed material is carried out at a temperature range of 50° C. to 200° C., for a period of about 3 seconds to 3 minutes.

7. The method of claim 1, wherein said β-diketonato-metal chelate compound is a metal chelated with a β-diketone compound represented by the following general formula (I)

$$R_1—COCH_2CO—R_2 \quad (I)$$

wherein $R_1$ and $R_2$ represent an aliphatic group, an aryl group, or a heterocyclic group.

8. The method of claim 7, wherein $R_1$ and $R_2$ each is a methyl group.

9. The method of claim 7, wherein said metal is Be, Mg, Al, Si, Ca, Sc, Ti, V, Cr, Mn, Fe, Co, Ni, Cu, Zn, Ga, Ge, Rb, Sr, Y, Zr, Nb, Mo, Tc, Ru, Rh, Pd, Ag, Cd, In, Sn, Cs, Ba, Ce, Sm, Nd, La, Hf, Ta, W, Re, Os, Ir, Pt, Au, Hg, Tl, Pb, Th, or U.

10. The method of claim 1, wherein said optical sensitizer is an organic dye.

11. The method of claim 10, wherein said organic dye is a carbonyl compound.

12. The method of claim 11, wherein said carbonyl compound is a quinone selected from the group consisting of compounds of the formula (IIIa) to (IIIf)

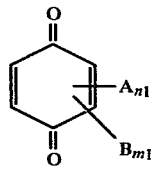
(IIIa)

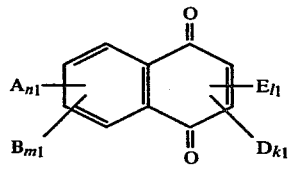
(IIIb)

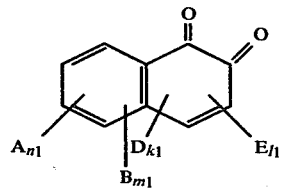
(IIIc)

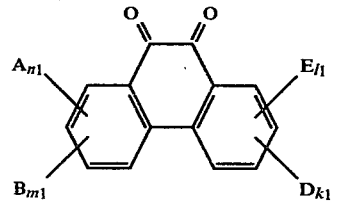
(IIId)

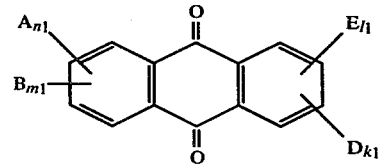
(IIIe)

-continued

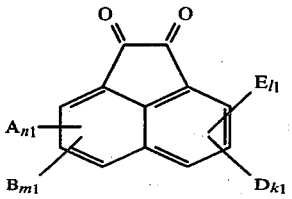
(IIIf)

wherein $n_1$, $m_1$, $l_1$, and $k_1$ are positive integers with the proviso that $n_1+m_1 \leqq 4$, and $l_1+k_1 \leqq 4$; and A, B, D and E each represents a hydrogen atom, an aliphatic group, an aryl group, a halogen atom, an —$OR_4$ group, a cyano group, a nitro group, an —$NR_4R_5$ group, an —$SO_3R_4$ group, a —$COOR_4$ group, an acyl group, a vinyl group, a styryl group, an allyl group, or an —$NHCOR_4$ group, in which $R_4$ and $R_5$ each is a hydrogen atom or an aliphatic group.

13. The method of claim 11, wherein said carbonyl compound is an aryl ketone selected from the group consisting of compounds of the formula (IVa) to (IVe)

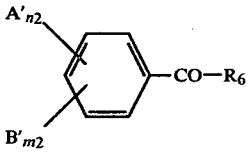
(IVa)

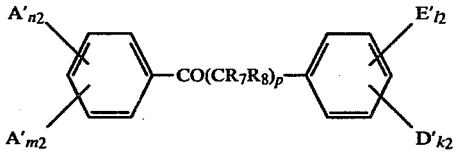
(IVb)

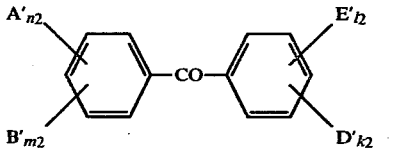
(IVc)

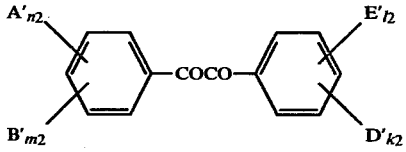
(IVd)

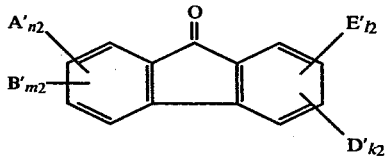
(IVe)

wherein $n_2$, $m_2$, $l_2$ and $k_2$ are positive integers; p is a positive integer; $R_6$ is a saturated aliphatic group, an acetylmethyl group, a benzoylmethyl group, or an alkenyl group; $R_7$ and $R_8$ each is an alkyl group or a halogen atom; and A', B', D' and E' each represents a hydrogen atom, an aliphatic group, an aryl group, a halogen atom, an —$OR_4$ group, a cyano group, a nitro group, an —$NR_4R_5$ group, —$SO_3R_4$ group, a —$COOR_4$ group, an acyl group, a vinyl group, a styryl group, an allyl group, or an $NHCOR_4$ group, in which $R_4$ and $R_5$ each is a hydrogen atom or an aliphatic group.

* * * * *